US005445204A

United States Patent [19]

van der Wielen

[11] Patent Number: 5,445,204

[45] Date of Patent: Aug. 29, 1995

[54] WINDOW BLINDS

[75] Inventor: Franciscus J. van der Wielen, Oosterhout, Netherlands

[73] Assignee: Hunter Douglas International N.V., Curacao, Netherlands Antilles

[21] Appl. No.: 371,454

[22] Filed: Jan. 11, 1995

Related U.S. Application Data

[63] Continuation of Ser. No. 69,522, Jun. 1, 1993, abandoned.

[30] Foreign Application Priority Data

Jun. 2, 1992 [GB] United Kingdom ..... 9211645

[51] Int. Cl.[6] ..... E06B 9/06

[52] U.S. Cl. ..... 160/84.04; 160/84.01

[58] Field of Search ..... 160/84.01–84.11, 160/113, 87, 115; 156/197

[56] References Cited

U.S. PATENT DOCUMENTS

| | | |
|---|---|---|
| 2,874,612 | 2/1959 | Luboshez . |
| 3,982,581 | 9/1976 | Madsen . |
| 4,544,011 | 10/1985 | Sawamura . |
| 4,928,369 | 5/1990 | Schnebly et al. . |

FOREIGN PATENT DOCUMENTS

| | | | |
|---|---|---|---|
| 249985 | 5/1963 | Australia . | |
| 134150A2 | 3/1985 | European Pat. Off. . | |
| 162025A3 | 11/1985 | European Pat. Off. . | |
| 0589846 | 9/1993 | European Pat. Off. . | |
| 674059 | 4/1939 | Germany | 160/84.1 C |
| 1950354 | 11/1966 | Germany . | |
| 3529418 | 8/1985 | Germany . | |
| 118227 | 2/1947 | Sweden | 160/84.1 C |
| 543937 | 3/1942 | United Kingdom | 160/84.1 C |
| 1051822 | 12/1966 | United Kingdom . | |

*Primary Examiner*—Blair M. Johnson

*Attorney, Agent, or Firm*—Gary M. Polumbus; Holland & Hart

[57] ABSTRACT

The blind has first pairs of planar members 21,22 hinged together at 23, and second pairs at 25,26 hinged together at 27, the members of one pair being connected to the members of the other pair by connectors 28,29 to form a zig-zag array and operating cords 42,43 pass through apertures 40,41 in the members, the cords passing freely through alternate members and physically engaging the other alternate members so that when longitudinal movement is between the cords 42,43 in one direction the first and second members are folded towards one another and the third and fourth members away from one another and when in the opposite direction the first and second members are folded away from one another and the third and fourth members folded towards one another to give two entirely distinct visual appearances. At least some of the members may be translucent to give an effect similar to that of a venetian blind.

36 Claims, 4 Drawing Sheets

WINDOW BLINDS

This is a continuation of application Ser. No. 08/069,522 filed on Jun. 1, 1993, abandoned.

The present invention relates to window blinds.

Various forms of window blind are available. These include roller blinds having a sheet of fabric which is rolled up on a roller mounted at the upper part of the window; pleated blinds in which pleated fabric, usually with a bottom rail and having horizontal pleats, can be raised and lowered; venetian blinds in which the slats can be tilted and a bottom rail can be raised and lowered to open the blind completely; louvre blinds in which vertically extending louvers can be tilted and moved to the left and right to open the blind and cellular blinds.

Venetian blinds in particular can be used to give a different lighting effect.

It is an object of the present invention to provide an alternative which is relatively easy and inexpensive to manufacture.

It is now proposed, according to the present invention, to provide a blind comprising a first set of pairs of elongate planar first and second members, the members of the first set of pairs being hinged together at a first series of hinge lines; a second set of pairs of elongate planar third and fourth members, the members of the second set of pairs being hinged together at a second series of hinge lines; a plurality of first and second connection means, the first connection means hingedly connecting the second members to next adjacent third members and the second connection means hingedly connecting first members to next adjacent fourth members, whereby the first series of hinge lines lie to one side of a given plane, the second series of hinge lines lie to the other side of said plane, and said first connection means lie in or to one side of said plane and the second set of hinge lines lie in or to the other side of said plane and whereby the planar members may be arranged in zig-zag array; and operating means to cause either the first and second members to be folded towards one another and the third and fourth members to be folded away from one another or the first and second members to be folded away from one another and the third and fourth members to be folded towards one another.

With such a blind different effects can be given by operating the first and second cords in one direction or the other of relative movement. For example, if at least some of the first and second members of a pair are dimensionally and/or visually different from one another, operation of the cords in one direction will give one visual effect and operation in the other direction will given another effect.

According to another modification, at least some of the pairs of elongate planar first and second members of the first set are dimensionally and/or visually different from the other pairs of the set. Additionally or alternatively at least some of the third and fourth members of a pair are dimensionally and/or visually different from one another and again at least some of the pairs of elongate planar third and fourth members of the second set may be dimensionally and/or visually different from the other pairs of the set.

Finally, the at least some pairs of first and second members of the first set are dimensionally and/or visually different from at least some pairs of third and fourth members of the second set. Using these various combinations, very different visual effects can be achieved.

In particular, according to one concept of the present invention, at least some of the members are opaque and at least some partly translucent. In this way, when the cords are operated so that the translucent members are folded away from one another, so that they are substantially aligned, and the opaque members are folded towards one another, so that they substantially overlie, the visual effect is very much that of an open venetian blind. When the cords are operated in the other sense, then the translucent members will overlie one another and opaque members will be folded away from one another so that they are aligned and the effect then will be similar to that of a closed venetian blind or indeed of a generally opaque blind.

The translucent effect may be achieved by the third and fourth members being perforated or being formed of a translucent plastics material. If they are perforated members then they may be in the form of perforated metal slats hinged to one another.

The first and second connection members may be of the same form or of a different form. In either event according to one embodiment they comprise at least one line of adhesive connecting the second members of the first set to the third members of the second set and the fourth members to the second set to the first members of the next adjacent pair of the first set.

According to another embodiment the connection means comprise a flexible strip of plastics material comprising a central flexible web portion and two edges portions each formed with a groove therein, the grooves accommodating the edges of the planar members.

According to a further embodiment the connection means comprise upper and lower layers of strip material laminated together at their centre and having edge portions of the relevant planar members sandwiched therebetween.

Very different effects can be achieved depending on the positioning of the first and second sets of hinge lines. It is contemplated that the first set of hinge lines could all lie in a first plane and the second set of hinge lines could lie in different planes from one another or that the second set of hinge lines could all lie in the second plane in which case the first set of hinge lines could again lie in different planes from one another.

However, according to preferred embodiment, the first set of hinge lines all lie in a first plane, the second set of hinge lines all lie in a second plane and the first plane to one side of the given plane and the second planes lies to the other side of the given plane.

The operating means may take many different forms. For example, if the first, second, third and fourth members are rigid, they may be hinged together by hinge pins and these hinge pins may extend axially beyond the members and be engaged by cords or chains located in side rails positioned adjacent the side edges of the blind. If the first, second, third and fourth members are formed of relatively soft materials, such as fabrics, then pins may be adhered to the hinge lines and be operated in a similar way to that described above.

However, in a presently preferred form of blind according to the invention, the blind further comprises a first set of aligned apertures formed in at least one of the sets of pairs of members and a second set of aligned apertures formed in at least one of the sets of pairs of members; and wherein said operating means comprise a first cord passing freely through said first set of apertures of one member of a pair and also through the first set of apertures in the other member of a pair, but physically engaging said other members and a second cord passing freely through said second set of apertures in one member of a pair and also through the second set of apertures in the other member of a pair, but physically engaging said other members.

The disposition of the apertures can be varied. In one structure according to the invention, the first and second sets of apertures are formed in the first and second members respectively. In another arrangement, the first set of apertures are formed in the first members and the second members and the second set of apertures are formed in the third members and the fourth members. In fact, the apertures can be disposed in any of the members provided that the cords engage alternate members and pass freely through the other alternate members.

In order to engage said other members, the first and second cords may be provided with knots or beads at spaced locations along the length, the knots or beads themselves physically engaging said other members.

In an alternative arrangement, the edges of the members are provided with inwardly directed recesses and said first set of apertures and said second set of apertures are provided in inserts slid into said recesses. With such a structure the inserts could each include a first notch through which the associated cord passes freely and a second narrow notch which can be locked against the cord.

It is also contemplated that at least one third set of aligned apertures should pass through all of the members and at least one third cord should pass through the apertures for expanding and contracting the blind. This can be achieved by providing a bottom rail connected to an end one of the members and to one end of said at least one third cord.

If a bottom rail is provided, this may have associated therewith a bar or pulley and the first and second cords are unitary or are connected to one another and pass around said bar or pulley. With such an arrangement, the simple operation of one cord in one direction will cause movement of the other cord in the opposite direction.

The third apertures are advantageously formed in the first and second members.

In order that the present invention may more readily be understood, the following description is given, merely by way of example, reference being made to the accompanying drawings in which:

FIG. 1 is a schematic side elevation of a portion of one embodiment of blind according to the invention;

FIGS. 2A and 2B respectively show two extreme positions in a schematic fashion of the blind of FIG. 1;

Figure 1:
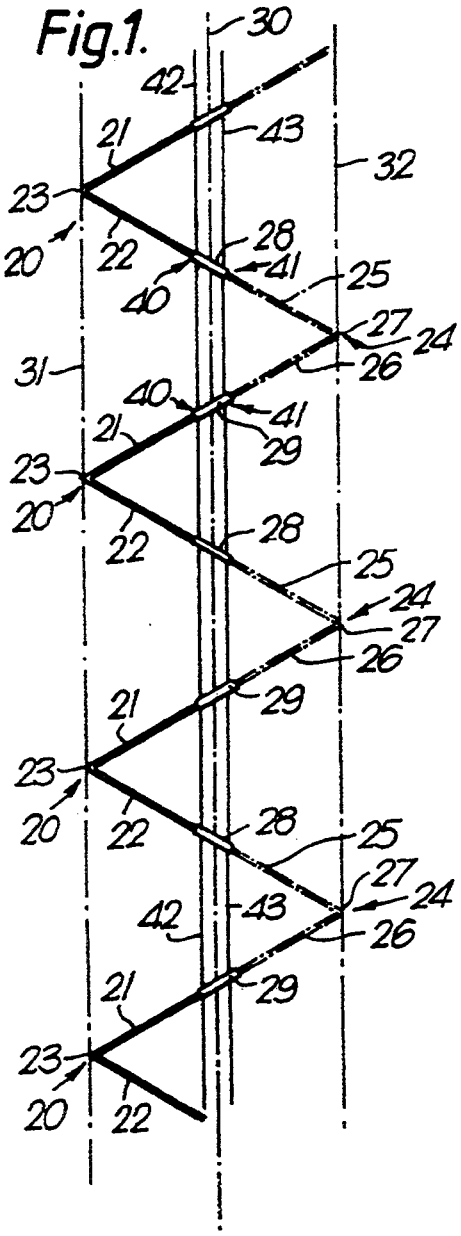

If reference is first made to FIG. 1, it will be seen that the blind illustrated therein comprises a first set 20 of pairs of elongate first and second members 21,22 hinged together along hinge lines 23. These are associated with a second set 24 of pairs of elongate planar third and fourth members 25,26 hinged together to one another at a second set of hinge lines 27.

In order to form the blind, first and second connecting means 28,29 are provided, the first connection means 28 hingedly connecting the second members 22 to next adjacent third members 25 and the second connection means 29 hingedly connect the first members 21 to next adjacent fourth members 26. In this way the first series of hinge lines 23 lie to one side of a generally central plane 30 and the second series of hinge lines 27 lie to the other side of said plane 30, and the first and second connection means 28,29 all lie on the generally central plane 30, whereby the planar members 21,22,25,26 are arranged in a zig-zag array. In this particular embodiment the first set of hinge lines 23 are located on a first plane 31 to one side of the generally central plane 30 and the second set of hinge lines 27 are located on a second plane 32 on the other side of the plane 30. The first and second planes 31,32 will, of course, move as the blind is operated.

A first set of aligned apertures 40 are formed, as shown, in the first and second members 21,22 and the second set of aligned apertures 41 are provided, as shown, in the third and fourth members 25,26.

A first cord 42 passes through the first set of apertures 40 and a second cord 43 passes through the second set of apertures 41.

Now the cord 42 passes freely through the apertures 40 in the second members 22 but is physically engaged by means to be described later with the first members 21.

Similarly, the cord 43 passes freely through the apertures 41 in the fourth members 26, but is physically engaged with the third members 25.

Figure 2A:
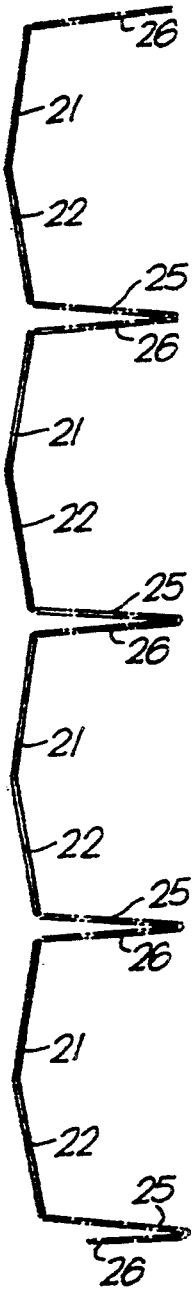

Now if the cord 42 is raised and/or the cord 43 lowered then the first pair of members 21,22 will be folded away from one another and the second pair of members 25,26 will be folded towards one another. In this instance the arrangement will be as shown in FIG. 2A in which the members 21,22 will become substantially aligned and the members 25,26 will become in substantially overlying relation.

Figure 2B:
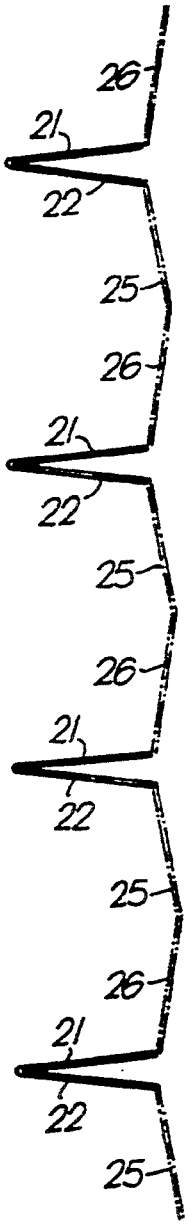

Now if the cords are moved in the reverse sense, that is the cords 42 lowered and/or the cords 43 raised, then the reverse situation will arise and the arrangement will be as shown in FIG. 2B.

It will be appreciated that if the first and second members 21,22 are made physically or visually different from the third and fourth members 25,26 then these two positions of the blind will give a totally different visual effect. If, for example, the members 21,22 are opaque and the members 25,26 are translucent, then in the position of FIG. 2B, the blind will become effectively a translucent blind and will give an appearance similar to that of a venetian blind with the slats in the open, parallel, horizontal position. On the other hand if with the arrangement shown in FIG. 2A, the effect will be similar to an opaque roller blind. Thus, by a very small movement of the cords 42,43 relative to each other two totally different appearances can be given.

Rather than one set being opaque and the other translucent, different pleasing effects can be achieved by making one set of one colour and the other set of another colour.

Figure 3:
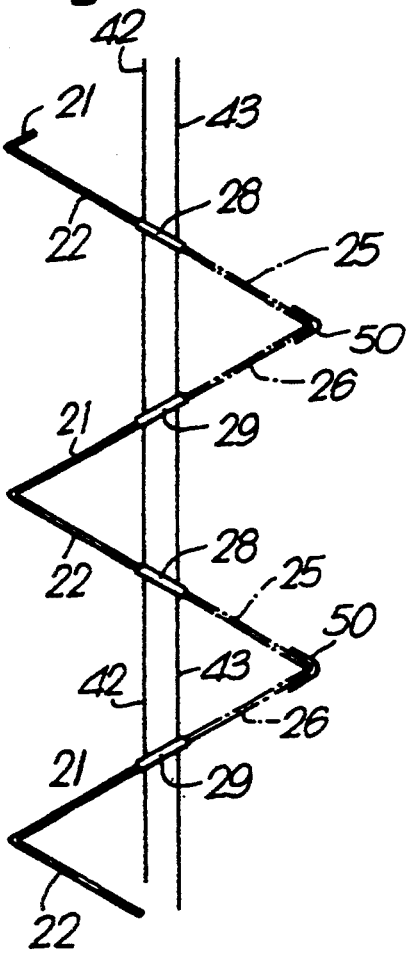
FIG. 3 is a view similar to FIG. 1 of a modification of the blind shown therein.

FIG. 3 shows a slight modification in which like parts being indicated by like reference numerals. In this structure, however, the third and fourth members 25,26 are formed as separate slats, rather than as folded elements and are connected by a flexible hinge member 50.

Figure 5:
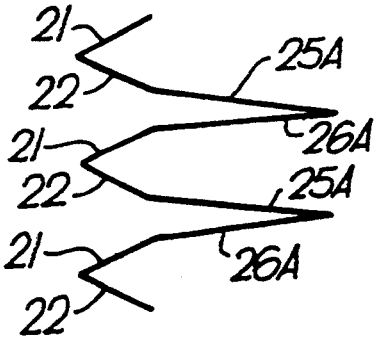
FIGS. 5, 6 and 7 are line drawing end elevations of three further embodiments of blind according to the invention.
Figure 6:
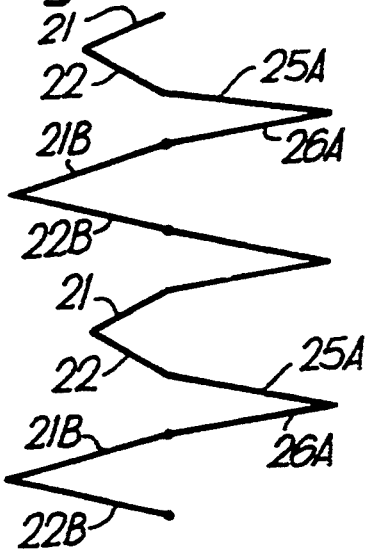
Figure 7:
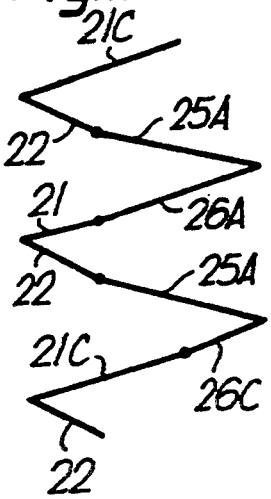

FIGS. 5, 6 and 7 show other configurations in which the relative sizes of the first, second, third and fourth members are shown as varied, again, like parts being indicated by like reference numerals. Variations are shown with a suffix letter.

For example in FIG. 5, the first and second members 21,22 are as in FIG. 1, but the third and fourth members *25a,26a*, are the same as each other but much wider than the first and second members 21,22.

In FIG. 6, there are two different sizes of first and second elements. As shown there are alternate members 21,22 as the same size as shown in FIG. 1. The other alternate first and second members *21b,22b* being of the same size as the enlarged third and fourth members *25a,26a*.

FIG. 7 shows a further variation in which alternate first members 21 are the same size as in FIG. 1, but the other alternate ones *21c* are much larger. The third and fourth members *25a,26a* are shown as in FIGS. 5 and 6 except that every alternate fourth member *26c* is again back to the same size as in FIG. 1. This gives a very different visual effect again.

Figure 4:
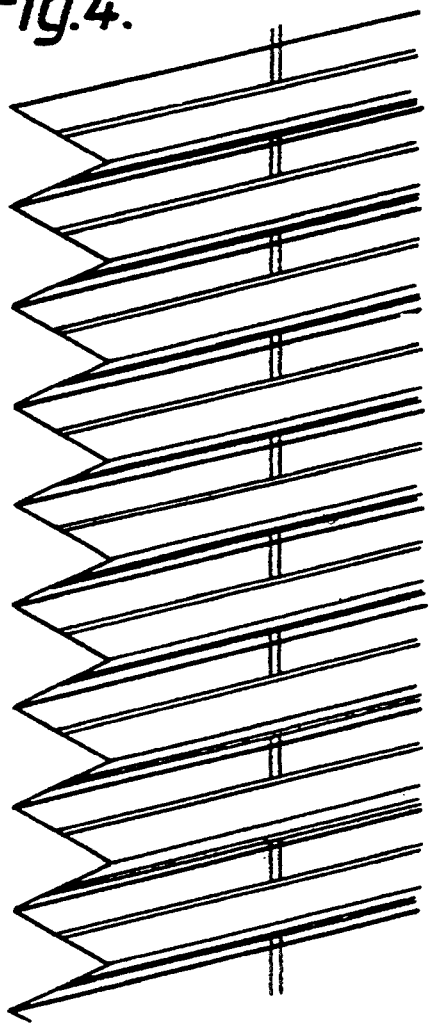
FIG. 4 is a schematic perspective view of the blind according to FIG. 1.

FIG. 4 shows the arrangement of FIG. 1 in perspective for the sake of greater clarity.

Figure 8:
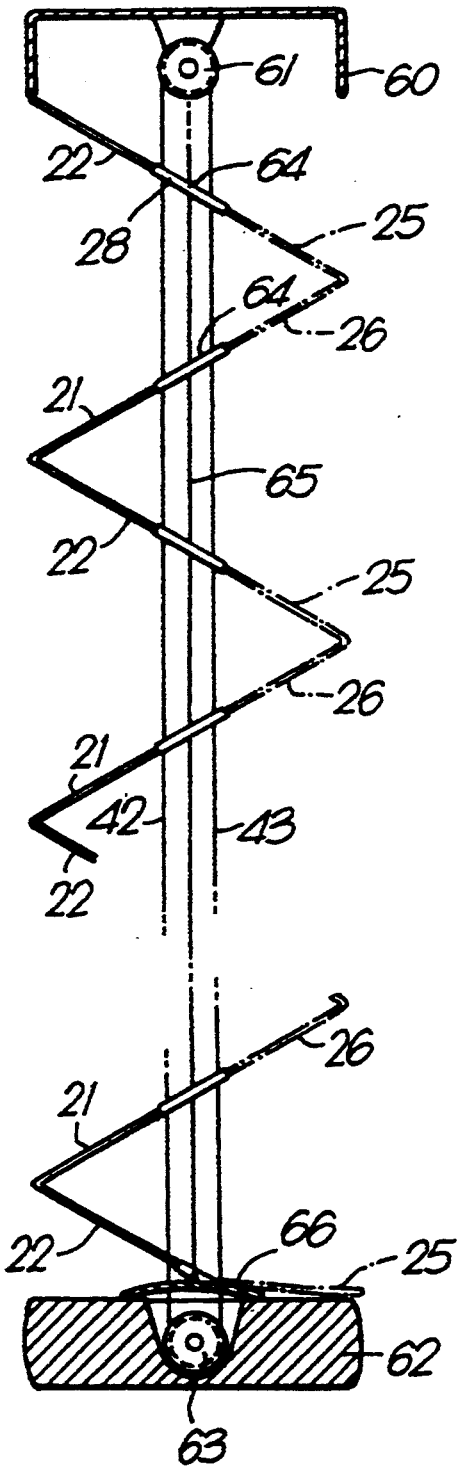
FIG. 8 is a more detailed showing of a complete blind as shown in FIG. 1 provided with a headrail, bottom rail and lift cords.

FIG. 8 shows a further modification in which a headrail 60 and a bottom rail 62 are each provided with pulleys 61,63 respectively. The connectors means 28,29 are here provided with a third set of apertures 64 through which passes downwardly a lift cord 65 which is secured to the bottom rail at 66 and is connected to means (not shown) for winding up the lift cord. The first and second cords 42,43 are passed over pulley 61 and under pulley 63. The upper pulley 61 may be used to cause relative movement between the first and second cords 42,43 as described in FIG. 1. It will be noted that the lowermost of the third members 25 is secured to the bottom rail 62 in this arrangement. Thus, one can raise and lower the blind just as one can raise and lower a venetian blind and one can produce the visual effects illustrated and referred to above in connection with FIG. 1 to 7.

Figure 9A:
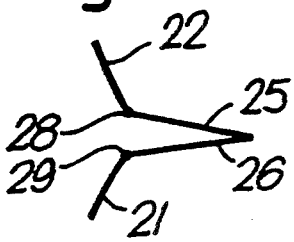
FIGS. 9A, 9B and 9C show three different forms of connecting means.
Figure 9B:
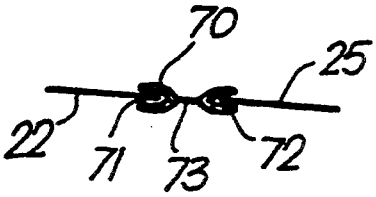
Figure 9C:
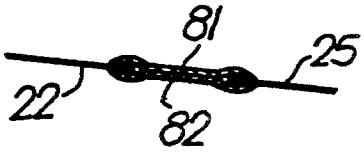

FIGS. 9A, 9B and 9C illustrate three different forms of connector. In FIG. 9A the connections 28,29 are simply formed by flexibly adhering the members 22 to the members 25 and the members 21 to the members 26.

In FIG. 9B a molded connector 70 is provided with recesses 71,72 on each side and a flexible centre 73.

In FIG. 9C upper and lower flexible members 81,82 are laminated together and sandwich the members which they connect therebetween, here illustrated as the members 22,25.

Figure 10A:
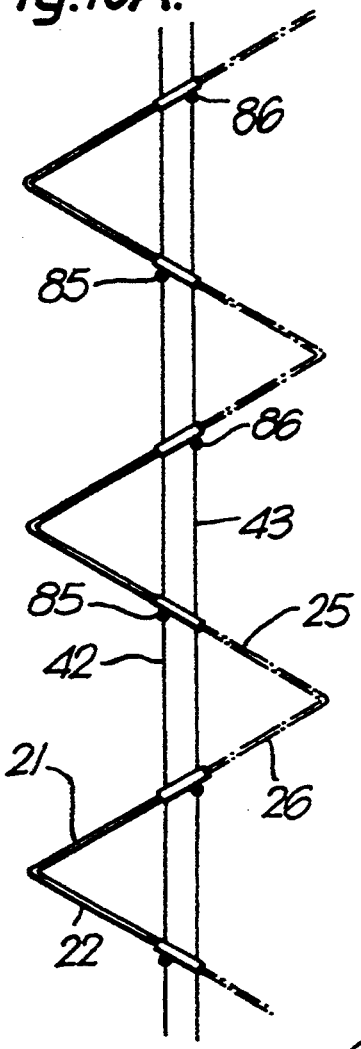
FIGS. 10A and 10B are side and perspective views of an edge portion of one of the members of the blind shown with an insert with the first and second cords passing therethrough.
Figure 10B:
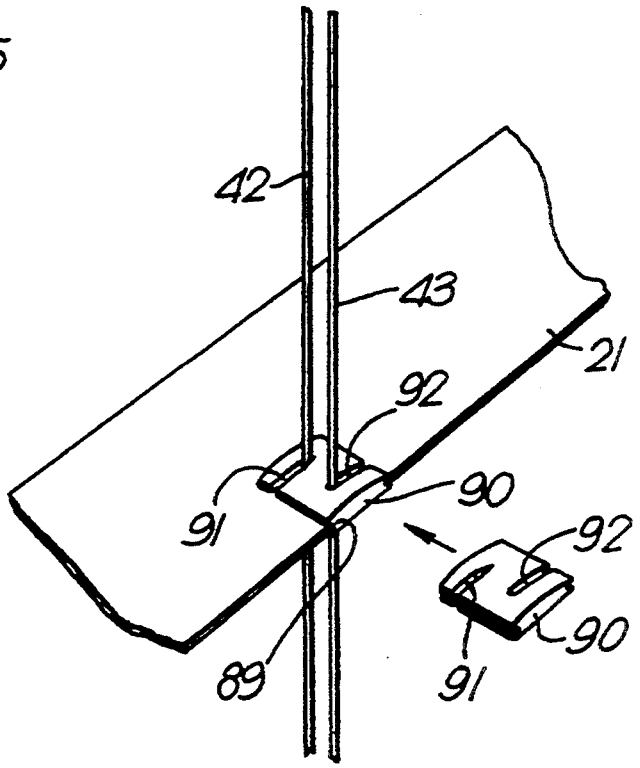

If reference is now made to FIGS. 10A and 10B, two different arrangements are provided for physically engaging the cords with alternate ones of the members. In FIG. 10A the cord 42 is provided with projections, such as beads or knots 85 which engage the slats 22, while the cords pass freely through the apertures in the members 21. Similarly projections such as beads or knots 86 on the cord 43 engage the fourth members 26 but pass freely through the second members 25.

A somewhat different arrangement is shown in FIG. 10B in which the slat 21 is provided with laterally extending recesses 89 into which is pressed and retained a molded insert 90. This insert has a V-shaped notch 91 on one side and a relatively open notch 92 on the opposite side. The cord 42 can be engaged in the V-notch 91 to secure the cord to the insert 90 and the cord 43 can pass freely through the notch 92. In the member below, the insert 90 can be inverted so that the cord 42 will pass freely and the cord 43 will be retained.

I claim:

1. A blind comprising a first set of pairs of elongate planar first and second members, the members of the first set of pairs being hinged together at a first series of hinge lines; a second set of pairs of elongate planar third and fourth members, the members of the second set of pairs being hinged together at a second series of hinge lines; a plurality of first and second connection means, the first connection means hingedly connecting the second members to next adjacent third members and the second connection means hingedly connecting first members to next adjacent fourth members, whereby the first series of hinge lines lie to one side of a given plane, the second series of hinge lines lie to the other side of said plane, and said first connection means lie in or to one side of said plane and the second set of connection means lie in or to the other side of said plane and whereby the planar members may be arranged in zigzag array; and operating means effective to cause either the first and second members to be folded towards one another and the third and fourth members to be folded away from one another or the first and second members to be folded away from one another and the third and fourth members to be folded towards one another.

2. A blind as claimed in claim 1, wherein at least some of the first and second members of a pair are dimensionally different from one another.

3. A blind as claimed in claim 1, wherein at least some of the pairs of elongate planar first and second members of the first set are dimensionally different from other pairs of the first set.

4. A blind as claimed in claim 1, wherein at least some of the third and fourth members of a pair are dimensionally different from one another.

5. A blind as claimed in claim 1, wherein at least some of the pairs of elongate planar third and fourth members of the second set are dimensionally different from the other pairs of the second set.

6. A blind as claimed in claim 1, wherein at least some pairs of first and second members of the first set are dimensionally different from at least some pairs of third and fourth members of the second set.

7. A blind as claimed in claim 1, wherein at least some of the members are opaque and at least some are at least partially translucent.

8. A blind as claimed in claim 7, wherein said at least partly translucent members are at least partly perforated.

9. A blind as claimed in claim 7, wherein said at least partly translucent members are formed of translucent plastics material.

10. A blind as claimed in claim 1, wherein the first and second connection means are of the same form.

11. A blind as claimed in claim 1, wherein at least some of the connection means comprise at least one line of adhesive connecting the second members of the first set to the third members of the second set and the fourth members to the second set to the first members of the next adjacent pair of the first set.

12. A blind as claimed in claim 1, wherein at least some of the connection means comprise a strip of plastics material comprising a central flexible web portion and two edges portions each formed with a groove therein, the grooves accommodating the edges of the planar members.

13. A blind as claimed in claim 1, wherein at least some of the connection means comprise upper and lower layers of strip material laminated together at their centre and having edge portions of the relevant planar members sandwiched therebetween.

14. A blind as claimed in claim 1, wherein the first set of hinge lines all lie in a first plane.

15. A blind as claimed in claim 1, wherein the second set of hinge lines all lie in a second plane.

16. A blind as claimed in claim 15, wherein the first set of hinge lines all lie in a first plane and wherein said first plane lies to one side of said given plane and said second plane lies to the other side of said given plane.

17. A blind as claimed in claim 1, and further comprising a first set of aligned apertures formed in at least one of the sets of pairs of members and a second set of aligned apertures formed in at least one of the sets of pairs of members; and wherein said operating means comprise a first cord passing freely through said first set of apertures of one member of a pair and also through the first set of apertures in the other member of a pair, but physically engaging said other members and a second cord passing freely through said second set of apertures in one member of a pair and also through the second set of apertures in the other member of a pair, but physically engaging said other members.

18. A blind as claimed in claim 17, wherein the first and second sets of apertures are formed in the first and second members.

19. A blind as claimed in claim 17, wherein the first set of apertures are formed in the first members and the second members and wherein the second set of apertures are formed in the third members and the fourth members.

20. A blind as claimed in claim 17, wherein the first and second cords further comprises knots or beads at spaced locations along their length, the knots or beads physically engaging said other members.

21. A blind as claimed in claim 17, wherein the edges of the members further comprises inwardly directed recesses and wherein said first set of apertures and said second set of apertures are provided in inserts slid into said recesses.

22. A blind as claimed in claim 21, wherein said inserts each comprise a first notch through which the associated cord passes freely and a second narrower notch which can be locked against a cord.

23. A blind as claimed in claim 17, and further comprising at least one third set of aligned apertures passing through said members and at least one third cord passing through said apertures for expanding and contracting said blind.

24. A blind as claimed in claim 23, and further comprising a bottom rail connected to an end one of said members and to one end of said at least one third cord.

25. A blind as claimed in claim 24, wherein said bottom rail further comprises a bar or pulley and wherein said first and second cords are unitary or are connected to one another and pass around said bar or pulley.

26. A blind as claimed in claim 23, wherein said third apertures are formed in said first and second members.

27. A blind as claimed in claim 1, wherein said first and second members are metal slats.

28. A blind as claimed in claim 1 or 2 wherein at least some of the first and second members of a pair are also visually different from one another.

29. A blind as claimed in claim 1 or 3 wherein at least some of the pairs of elongate planar first and second members of the first set are also visually different from other pairs of the first set.

30. A blind as claimed in claim 1 or 4 wherein at least some of the third and fourth members of a pair are visually different from one another.

31. A blind as claimed in claim 1 or 5 wherein at least some of the pairs of elongate planar third and fourth members of the second set are visually different from the other pairs of the second set.

32. A blind as claimed in claim 1 or 6 wherein at least some pairs of first and second members of the first set are visually different from at least some pairs of third and fourth members of the second set.

33. A blind comprising first pairs of elongate planar first and second members, the first and second members of each first pair being hinged together at a first series of hinge lines whereby the first series of hinge lines lie in or to one side of a given plane and operating means to cause either the first and the second members to be folded towards one another in a position perpendicular to said given plane or the first and the second members to be folded away from one another to co-extend in a plane parallel to or common with said given plane, said blind further comprising a second pair of elongate planar third and fourth members, the third and fourth members of each second pair being hinged together at a second series of hinge lines, a plurality of first connection means hingedly connecting the second members to next adjacent third members and second connection means hingedly connecting first members to next adjacent fourth members, said operating means also being effective to cause the third and fourth members to be folded away from one another in response to the first and second members being folded towards one another and effective to cause the third and fourth members to be folded towards one another in response to the first and second members being folded away from one another.

34. A blind according to claim 33, wherein said second series of hinge lines lie in or to another side of said given plane.

35. A blind comprising a first set of pairs of elongate planar first and second members, the members of said first set of pairs being hinged together at a first series of hinge lines; a second set of pairs of elongate planar third and fourth members, the members of said second set of pairs being hinged together at a second series of hinge lines; a plurality of first and second connection means, each first connection means hingedly connecting a second member to the next adjacent third member and each second connection means hingedly connecting a first member to the next adjacent fourth member; and operating means effective to cause either the first and second members to be folded towards one another and the third and fourth members to be folded away from one another or the first and second members to be folded away from one another and the third and fourth members to be folded towards one another.

36. A blind comprising first pairs of elongate planar first and second members, the first and second members of each first pair being hinged together along a first hinge line; second pairs of elongate planar third and fourth members, the third and fourth members of each second pair being hinged together along a second hinge line; a plurality of first and second hinge connectors, each first hinge connector hingedly connecting each second member to the next adjacent third member and each second hinge connector hingedly connecting a first member to the next adjacent fourth member; and an operator connected to said members and operative selectively to cause either said first and second members to be folded towards one another and said third and fourth members to be folded away from one another or said first and second members to be folded away from one another and said third and fourth members to be folded towards one another.

* * * * *